US005591516A

United States Patent [19]

Jaco et al.

[11] Patent Number: 5,591,516

[45] Date of Patent: Jan. 7, 1997

[54] DURABLE, PILL-RESISTANT POLYESTER FABRIC AND METHOD FOR THE PREPARATION THEREOF

[75] Inventors: Pamela J. Jaco, Rock Hill; Mark A. Anderson, Anderson; Michael G. Simmons, Rock Hill, all of S.C.; Terry G. Montgomery, Matthews, N.C.

[73] Assignee: Springs Industries, Inc., Fort Mill, S.C.

[21] Appl. No.: 479,178

[22] Filed: Jun. 7, 1995

[51] Int. Cl.[6] ..... B32B 7/00

[52] U.S. Cl. ..... 428/253; 427/322; 427/389.9; 428/254; 428/265; 428/409

[58] Field of Search ..... 427/322, 389.9; 428/253, 254, 265, 409, 85, 86, 96

[56] References Cited

U.S. PATENT DOCUMENTS

| | | | |
|---|---|---|---|
| 2,706,845 | 4/1955 | Swan . | |
| 3,287,787 | 11/1966 | Goulding et al. . | |
| 3,539,286 | 11/1970 | Bowers . | |
| 3,649,165 | 3/1972 | Cotton . | |
| 3,674,417 | 7/1972 | Otto . | |
| 3,702,231 | 11/1972 | Dale . | |
| 3,749,597 | 7/1973 | Hartgrove, Jr. . | |
| 3,894,318 | 7/1975 | Ito et al. . | |
| 4,004,878 | 1/1977 | Magosch et al. . | |
| 4,185,961 | 1/1980 | Danzik . | |
| 4,468,844 | 9/1984 | Otto . | |
| 4,743,267 | 5/1988 | Dyer . | |
| 4,851,291 | 7/1989 | Vigo et al. . | |
| 4,908,238 | 3/1990 | Vigo et al. . | |
| 4,927,698 | 5/1990 | Jaco et al. . | |
| 5,058,329 | 10/1991 | Love et al. . | |
| 5,332,625 | 7/1994 | Dunn et al. | 428/409 |
| 5,456,975 | 10/1995 | Zador et al. | 428/265 |
| 5,503,917 | 4/1996 | Hughes | 428/409 |

FOREIGN PATENT DOCUMENTS

| | | |
|---|---|---|
| 53-74200 | 1/1978 | Japan . |

*Primary Examiner*—James J. Bell
*Attorney, Agent, or Firm*—Bell, Seltzer, Park & Gibson, P.A.

[57] ABSTRACT

The invention discloses a durable, resin coated pill resistant polyester fabric, a method for producing such a fabric, and bedding made from the fabric. The fabric is made from substantially all polyester and it is microsanded to abrade the fabric surface. An antipilling resin which contains a self-crosslinking acrylic copolymer and a methylol derivative resin is applied to the fabric and then the fabric is treated to crosslink the anti-pilling finish, thereby forming a pill resistant fabric. The fabric is particularly useful for forming bedding products for the industrial and hospitality markets, as the fabric is capable of withstanding numerous launderings at industrial pH and temperature levels without becoming thin or acquiring a large amount of pills on its surface.

17 Claims, 5 Drawing Sheets

DURABLE, PILL-RESISTANT POLYESTER FABRIC AND METHOD FOR THE PREPARATION THEREOF

FIELD OF THE INVENTION

The invention relates to a durable, finish-coated pill-resistant polyester fabric, a method for making a finish-coated, pill-resistant polyester fabric, and articles of bedding made therefrom.

BACKGROUND OF THE INVENTION

Historically, bedding fabrics used in the industrial environment, e.g. in hospitals, hotels and the like have been made from natural fibers such as cotton. Bedding materials made from cotton fabric, however, lack the strength and durability required when the products are to be subjected to the relatively more harsh institutional or industrial launderings, because fabrics made of cotton tend to lose fiber density due to fiber breakage in response to abrasion. Therefore, bedding articles made from cotton fabric tend to become thin after a relatively low number of uses and launderings resulting in a useful life that is undesirably short.

To enhance fabric strength, cotton fibers are sometimes blended with synthetic fibers such as polyester to form bedding fabrics. While providing improved fabric durability over 100% cotton fabrics, even these blended fabrics cannot normally withstand repeated launderings at the high pH levels and temperatures of institutional or industrial launderings. Therefore, the life span of the blended fabrics also tends to be undesirably low. For example, conventional cotton/polyester blended sheets usually survive only about 70–120 institutional washes at their relatively elevated pH levels and temperature.

Fabrics and bedding articles from 100% synthetic fibers such as polyester also have various drawbacks. Fabrics formed from continuous filament polyester tend to be very durable; however, they have an undesirable hand and can be unsatisfactory to consumers. Fabrics made from staple polyester, while having a more desirable hand, suffer from a propensity to acquire a large number of pills on their surfaces when they are used. Fabric pilling results from abrasion of the fabric surface which causes damage to protruding staple fibers. Although some fibers, such as cotton, are sufficiently weak that abrasion causes breakage and shedding of the fibers and fiber pieces, higher tenacity fibers such as polyester are not normally broken by abrasion. Instead the fiber ends stretch and wrap together into small balls or pills. Thus following substantial use the fabric can have a high number of pills on its surface resulting in an undesirable surface texture, particularly for bedding applications such as sheets.

Substantial efforts by numerous concerns including fiber manufacturers, fabric manufacturers, chemical concerns and others, have been directed over many years in various efforts to reduce the pilling of polyester fabrics. One such method involves abrading the fabric surface in order to weaken the fibers so that broken fiber pieces can be more readily released from the fabric surface. For example, U.S. Pat. No. 2,706,845 to Swan discloses a method of imparting pill resistance to a fabric containing synthetic staple fibers by brushing the fabric to disfigure the fibers and thereafter locking the disfigured fiber ends in the fabric surface by shrinking. Another example, U.S. Pat. No. 3,894,318 to Ito et al, discloses a method of enhancing pilling resistance of fabrics containing synthetic staple fibers by contacting the fabric surface with an abrasive surface to form defects in the fibers distributed along the fabric surface. Still other efforts have been directed to weakening the fiber structure by various chemical treatments; however, these efforts, when successful, also reduce fabric durability.

One hundred percent (100%) polyester fabrics also typically suffer from very low moisture absorbency, particularly in woven products such as sheets, and are considered by some consumers to have a "clammy" feel. This is generally believed to be due to the hydrophobic nature of polyester.

Many finishes which adhere well to cellulosic fibers such as cotton do so because they are able to bond with the —OH groups of cellulosic fibers. Because polyester has essentially no free surface groups available for bonding, the finishes which adhere well to other materials such as cotton fibers do not tend to adhere well to polyester. Typically, finishes applied to fabrics formed from polyester fibers tend to wash off of the fabrics as a result of repeated launderings.

Thus despite substantial effort and research, fully satisfactory polyester fabrics suitable for bedding and the like which are resistant to the formation of pills and capable of withstanding numerous launderings at institutional or industrial temperature and pH levels are still not available. Likewise, non-pilling polyester which is both durable and absorbent is still the subject of significant research, but with little success.

SUMMARY OF THE INVENTION

The subject invention provides durable, absorbent and highly pill-resistant polyester fabrics. Polyester fabrics of the invention have a desirable hand and drapability and are typically formed of all or substantially all polyester staple fibers, e.g., 97–100% polyester. The fabrics of the invention have been found capable of undergoing hundreds of high temperature, high pH industrial launderings without substantial pilling or loss of capability for moisture transport and absorption. Fabrics of the invention do not decrease substantially in fiber density or fabric thickness as a result of such industrially harsh treatment; nevertheless, the staple fibers making up the fabric do not gather into pills.

Polyester fabrics according to the invention are prepared employing an advantageous combination of surface treatments. In combination, these treatments have been found to provide polyester fabrics exhibiting a combination of highly desirable properties including softness, moisture absorption, durability and pilling resistance up to and exceeding 1000 industrial launderings in preferred embodiments of the invention. The polyester fabrics of the invention are preferably woven or knit fabrics formed of any of various conventional polyester staple fibers. The fabric is treated by abrasion, preferably microsanding, to provide softer, more absorbent fabric surfaces. Although abrasion treatments such as microsanding have been previously employed to reduce fabric pilling, the resultant fabrics still generally suffer pilling after extended and/or harsh use, with the result that the softer, more desirable fabric surface property is lost.

In accordance with the present invention, the abraded fabric surface is treated with a highly durable fabric finish, which encapsulates the fiber surfaces in the fabric. Although in the past durable finishes have rarely been padded with success to polyester fabrics, it has been found that the finish used in the present invention, when applied to abraded polyester fiber surfaces, has a surprisingly extended lifetime exceeding several hundred industrial launderings. The finish also substantially preserves the abraded fibers within the fabric, yet nevertheless, minimizes or eliminates pilling which normally results from preservation of polyester staple fiber strength. Moreover, despite the substantial durability of the finish used in accordance with the invention, the fabric surface and hand are not substantially harmed. Moreover, the highly durable, pill resistant fabrics of the invention have substantially improved moisture absorption and moisture transport properties.

In a preferred embodiment of the invention, a woven polyester fabric comprising greater than about 97–98% polyester fibers, is provided in a form to be used as a bedding article such as a sheet or the like. The fabric is microsanded and treated with a self-crosslinking acrylic copolymer and a methylol derivative resin. Particularly preferred resin-polymer finishes are prepared from a polybutylacrylate copolymer and dimethyloldihydroxyethylene urea.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

For purposes of this invention, the term "polyester fabric" is used to define fabrics woven or knit essentially from polyester fibers. Polyester fabrics within the scope of this invention may include small amounts of antistatic, antimicrobial or other functional finishes or fibers, provided the fabrics are still essentially polyester, e.g. greater than 80 wt. % and preferably greater than 90–95 wt. % polyester.

Figure 1:
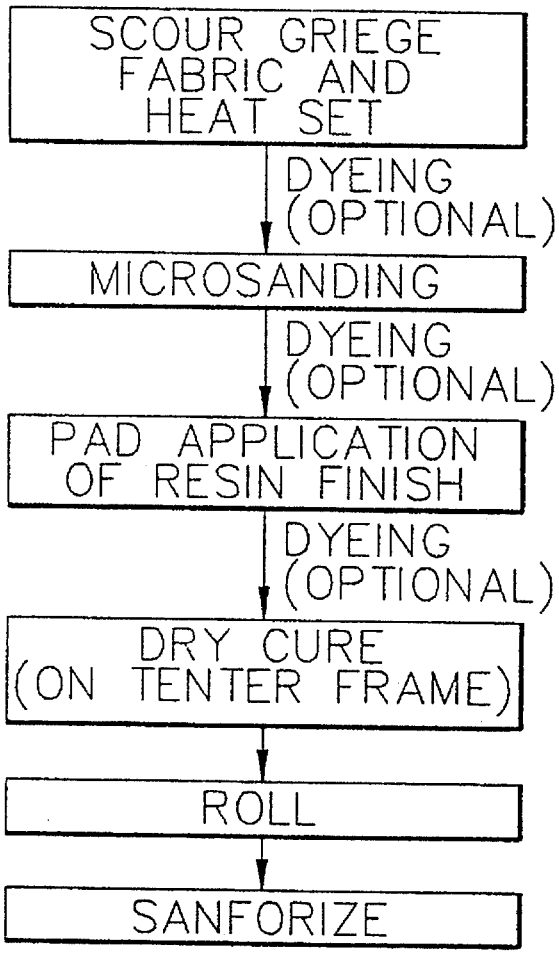
FIG. 1 is a flow-chart showing the method of the present invention.

FIG. 1 depicts the method of the present invention. According to the method, a fabric made from substantially all polyester fibers is scoured and heat set according to conventional methods. It is particularly preferred that the fabric is 100% polyester, though small amounts of other fibers may be included, provided the fabric is primarily made from polyester fibers. For example, small amounts of antimicrobial or antistatic fibers may be included in order to provide the fabric with those properties.

Fabrics made from textile grade medium tenacity polyester fibers have been found to perform particularly well in the invention, because they tend to pill less readily than their high tenacity counterparts. However, fibers having a tenacity level which is too low are undesirable in that they can be difficult to convert to a spun yarn. Particularly preferred are fibers having a tenacity of approximately 5 grams force per denier (g/den). The denier of the fibers can also be significant because large denier fibers tend to produce fabrics having a less desirable hand than those of smaller deniers. Particularly preferred are fibers having a denier per filament (dpf) of between about 0.7 and about 1.5, more preferably between about 0.9 land 1.3 dpf, and most preferably about 1.0. Therefore, the fibers used to form the fabric preferably possess a desirable balance between tenacity and denier in order to provide a durable fabric with a good hand.

The scoured and heat set fabric is microsanded in order to slightly abrade the fibers along at least one, and preferably both surfaces, i.e., front and back surfaces, of the fabric. This is preferably done by feeding the fabric through any of various well-known microsander apparatus such as those commercially available (Menschner being one brand), which are conventionally used to form a soft finish on apparel fabrics. The microsander, which usually uses about six to eight sandpaper-covered rolls, preferably has some of the rolls disengaged in order that the fabric is not abraded too severely. Advantageously the fabric is contacted on each surface by one or two rolls covered with a fine grit sandpaper. Where two rolls are used, they are preferably rotated counter-directional to one another.

The finishes are then applied to the microsanded fabric. This can be done by conventional padding methods such as by feeding the fabric through a pad bath, then through sets of opposing rollers or pads to press the finish into the fabric. Alternatively, other application techniques such as spraying, knifing, printing, foaming, vacuuming, etc. can be used to apply the resin finish onto the fabric. The preferred resin finish comprises a self-crosslinking acrylic copolymer and a methylol derivative resin as disclosed in U.S. Pat. No. 4,927,698 to Jaco et al, which is hereby incorporated by reference. A particularly preferred self-crosslinkable acrylic copolymer is polybutylacrylate copolymer, while a particularly preferred methylol derivative resin is dimethyloldihydroxyethylene urea (DMDHEU). A melamine derivative can also be used as the methylol derivative resin; however, this is believed to be less desirable for the formation of institutional bedclothing due to free formaldehyde which can remain following crosslinking of the resin, since formaldehyde is a known irritant.

Although self-crosslinking acrylic resins are preferred, various other self-crosslinking resins can be used alternatively or in combination. The resin finish preferably comprises an aqueous self-crosslinking copolymer produced by emulsion polymerization of one or more polymerizable primary monomers in the presence of a smaller proportion of at least one reactive functional latent-crosslinking comonomer. The major portion of the aqueous self-crosslinking emulsion polymer is derived from one or more ethylenically unsaturated monomers which are copolymerizable with the latent-crosslinking comonomer. Examples of suitable ethylenically unsaturated monomers include alpha olefins such as ethylene, propylene, butylene, isobutylene; diene monomers such as butadiene, chloroprene, isoprene; and aromatic and aliphatic vinyl monomers including vinyl halides such as vinyl chloride and vinylidene chloride; vinyl esters of alkanoic acids having from one to eighteen carbon atoms, such as vinyl formate, vinyl acetate, vinyl propionate, vinyl butyrate, vinyl isobutyrate, vinyl valerate, vinyl 2-ethylhexanoate, vinyl isoctanoate, vinyl monoate, vinyl decanoate, vinyl pivalate, vinyl Versatate®; vinyl esters of saturated carboxylic acids; vinyl aromatic compounds such as styrene, alpha methylstyrene, vinyl toluene, 2-bromostyrene, p-chlorostyrene; and other vinyl monomers such as acrylonitrile, methacrylonitrile, N-vinylpyrrolidone, maleate, fumarate, and itaconate esters of $C_1$ to $C_8$ alcohols. Preferred resins are based on acrylic monomers and in particular $C_2$–$C_{18}$ alkyl acrylates and $C_2$–$C_{18}$ alkyl methacrylates. Examples of the $C_2$–$C_{18}$ alkyl groups of the esters of acrylic and methacrylic acids which are useful in forming the copolymers of the invention include methyl, ethyl, n-butyl, i-butyl, sec-butyl, t-butyl, the various isomeric pentyl, hexyl, heptyl, and octyl (especially 2-ethylhexyl), isoformyl, lauryl, cetyl, stearyl, and like groups. Preferred ethylenically unsaturated monomers for the present invention are selected from the group consisting of aliphatic and aromatic vinyl monomers. Especially preferred as the primary monomers are unsaturated monomers selected from the group consisting of alkyl acrylates, alkyl methacrylates, acrylonitrile, acrylamide, styrene and vinyl acetate. It is particularly suitable to use mixtures of two or more ethylenically unsaturated monomers such as butyl acrylate and methyl methacrylate, butyl acrylate and styrene, butyl acrylate and acrylonitrile, butyl acrylate and vinyl acetate, ethyl acetate and styrene, and ethyl acetate and methyl methacrylate.

The latent-crosslinking monomers which are preferred for use in the present invention are characterized by being readily copolymerizable with the other monomers, and also by being capable of curing, generally in the presence of a catalyst, by means of heat or radiation. Suitable latent-crosslinking monomers may be broadly characterized as N-alkylolamides of alpha, beta ethylenically unsaturated carboxylic acids having 3–10 carbons, such as N-methylol acrylamide, N-ethanol acrylamide, N-propanol acrylamide, N-methylol methacrylamide, N-ethanol methacrylamide. Also suitable are methylol maleamide, N-methylol maleamide, N-methylol maleamic acid, N-methylol maleamic acid esters, the N-alkylol amides of the vinyl aromatic acids such as N-methylol-p-vinybenzamide and the like, N-butoxymethyl acrylamide, N-methylol allyl carbamate, glycidyl acrylate, glycidyl methacrylate, hydroxyethyl acrylate, hydroxypropyl acrylate and the corresponding methacrylates. Particularly preferred as a latent-crosslinking monomer for use in the present invention is N-methylolacrylamide or mixtures of N-methylolacrylamide and acrylamide, as acrylamide will impart moisture regain but not latent crosslinks.

The latent-crosslinking monomers are present in an amount sufficient to cure the copolymer film to make it less soluble, and the monomers along with the methylol derivative resin detackify the copolymer, to thereby enable crosslinking of the composition around the yarn and fibers. The latent-crosslinking monomers, however, are provided in an amount which is less than that which would cause any significant premature crosslinking during formulation and application. The latent-crosslinkable monomers preferably are present in an amount ranging from about 5 to 100 parts per 1000 parts of the primary monomers, by weight, and most desirably about 10 to 60 parts per 1000 parts of the primary monomers. This typically represents about 0.5 to 10 percent by weight of the copolymer.

Copolymers in accordance with the present invention also may desirably include small amounts of an acid monomer, preferably an ethylenically unsaturated carboxylic acid. Generally, any ethylenically unsaturated mono or dicarboxylic acid may be used to provide the carboxyl functionality. Examples of suitable acids include the monocarboxylic ethylenically unsaturated acids such as acrylic, vinyl acetic, crotonic, methacrylic, sorbic, tiglic, etc.; the dicarboxylic ethylenically unsaturated acids such as maleic, fumaric, itaconic, citraconic, hydromuconic, allylmalonic, etc., as well as dicarboxylic acids based on maleic acid such as mono(2-ethylhexyl) maleate, monoethylmaleate, monobutylmaleate, monomethylmaleate. Especially suitable are acid monomers selected from the group consisting of acrylic acid, methacrylic acid, crotonic acid, maleic acid, and itaconic acid. In accordance with the present invention, the presence of acid monomers in small amounts, typically ranging from about 0.1 to 10 percent by weight of the copolymer (1 to 100 parts per 1000 parts of the primary monomer), and most desirably 1 to 4 percent, acts as a functional site for crosslinking with other latent-crosslinking agents.

The copolymer also preferably includes small amounts of active crosslinking monomers to give internal crosslinking and branching to increase the molecular weight of the copolymer. By the term "active crosslinking monomer" is meant a polyfunctional monomer which crosslinks a polymer composition during the initial formation thereof. Subsequent drying and curing techniques are not required. Monomers of this type comprise monomers which contain two or more ethylenically unsaturated groups in one molecule capable of undergoing additional polymerization by free radical means.

Examples of suitable active crosslinking monomers include alkylene glycol diacrylates and methacrylates such as ethylene glycol diacrylate, 1,3-butylene glycol diacrylate, propylene glycol diacrylate, triethylene glycol dimethacrylate, etc., 1,3-glycerol dimethacrylate, 1,1,1-trimethylol propane dimethacrylate, 1,1,1-trimethylol ethane diacrylate, pentaerythritol trimethacrylate, 1,2,6-hexane triacrylate, sorbitol pentamethacrylate, methylene bisacrylamide, methylene bismethacrylamide, divinyl benzene, vinyl methacrylate, vinyl crotonate, vinyl acrylate, vinyl acetylene, trivinyl benzene, triallyl cyanurate, triallyl isocyanurate, divinyl acetylene, divinyl ethane, divinyl sulfide, divinyl ether, divinyl sulfone hexatriene, diallyl cyanamide, ethylene glycol divinyl ether, diallyl phthalate, divinyl dimethyl silane, glycerol trivinyl ether, divinyladipate, allyl methacrylate, allyl acrylate, diallyl maleate, diallyl fumarate, diallyl itaconate, diallyl succinate, diallyl malonate, diallyl carbonate, triallyl citrate, triallyl aconitate.

The amount of the active crosslinking monomer may typically range from about 0.01 to about 2.0 percent (0.1 to 20 parts per 1000 parts of primary monomer), preferably 0.05 to 0.6 percent by weight of the copolymer. The molecular weight of the emulsion copolymer, prior to final drying and curing, is quite high and may typically range from 100,000 to several million.

As earlier noted, the aqueous self-crosslinking copolymer is produced by emulsion copolymerization using conventional emulsion polymerization procedures and surfactants, polymerization catalysts and other additives as are conventional for such procedures. These procedures and the various surfactants, catalysts, and other additives are known in the art. The practice of emulsion polymerization is discussed in detail in D. C. Blackley, "Emulsion Polymerization", (Wiley, 1975). The size of the resulting polymer particles in the emulsion may typically range from 0.05 to 1.0 microns, preferably about 0.1 to about 0.5 microns. The polymer emulsion typically has a solids content of about 40 to 60 percent as produced.

The methylol derivative resin should be compatible with and have an affinity for the acrylic copolymer. Suitable methylol derivative resins include methylol derivatives of cyclic ureas or methylol carbonates, of which the following are examples: dimethylol ethylene urea (DMEU), ethyl carbonates, and dimethylol dihydroxyethylene urea (DMDHEU). DMDHEU, sometimes called glyoxal resin, is the preferred resin for this purpose. The glyoxal resin can be prepared in any known and convenient manner from glyoxal, urea, and formaldehyde, and the systems of this invention are applicable to dimethylol dihydroxyethylene urea (DMDHEU), its partially and completely methylated derivatives, and other appropriate derivatives. Also the resin composition may include a catalyst such as a magnesium chloride hexahydrate/maleic acid mixture and a surfactant mixture such as nonylphenolethyoxylate and dioctylsodium sulfosuccinate.

Preferably the resin finish comprises from about 10 to 15 percent by weight of the self-crosslinking acrylic copolymer and from about 3 to 7 percent by weight of the methylol derivative resin. These concentrations give an optimal level of resin add-on while maintaining a good level of absorbency. This is particularly important when the treated fabrics are to be used to form bedding products, because absorbency rates which are too slow result in uncomfortable bedding products. In order to enhance the fabric absorption, it can optionally be treated by one of the conventional processes for enhancing the moisture absorbency of polyester fabrics. Examples of such methods are known in the art under the tradenames MAWAS, INTERA, and COMFORT TECH. The crosslinkable composition may include various softeners, fillers, binders, thickeners, etc. to improve the processability, to aid in applying the coating, and to improve the hand of the fabric. The resin finish also desirably includes a catalyst for assisting in the resin curing process; in addition small amounts of a surfactant and a softener may be included to assist in the resin application.

The finish coated fabric is then treated to activate the crosslinking reaction within the resin-polymer finish. The crosslinking reaction may be activated by heating, radiation, or electron beam curing, and may employ catalysts or free radical initiators in a manner known in the art. The preferred method of curing the fabric is by dry curing it on a tenter frame. The cured finish bridges and coats the fibers forming the fabric in a three-dimensional shaped structure and, thereby forms a lasting finish which does not wash off during launderings, even those at industrial pH and temperature levels, due to the high adherence of the finish to the fabric. Even though the mechanism is not fully understood, it is believed that the cross-linked finishes mechanically adhere to the otherwise inert polyester fiber surface. Nevertheless, the finish can preserve fabric softness.

Advantageously, the fabric bearing the cured finish is then rolled and shrink treated, preferably by a compressive shrinkage treatment such as that known under the tradename SANFORIZING. The shrinkage treatment, in addition to providing controlled shrinkage of the fabric, also improves the fabric hand by breaking the finish to soften the fabric. Then the fabric is ready to be converted to various end use products, such as bedding for the industrial and hospitality markets.

If desired the fabric can also be dyed to provide a colored fabric. The fabric dyeing step can occur at any point along the fabric finishing process, such as prior to or subsequent to microsanding. Alternatively, a dye can be applied, e.g. by printing, transfer printing, or padding a dye into the fabric along with the resin finish, provided the dye is chemically stable with respect to the resin and does not interfere with the application of the finish to the fabric.

Figure 2:
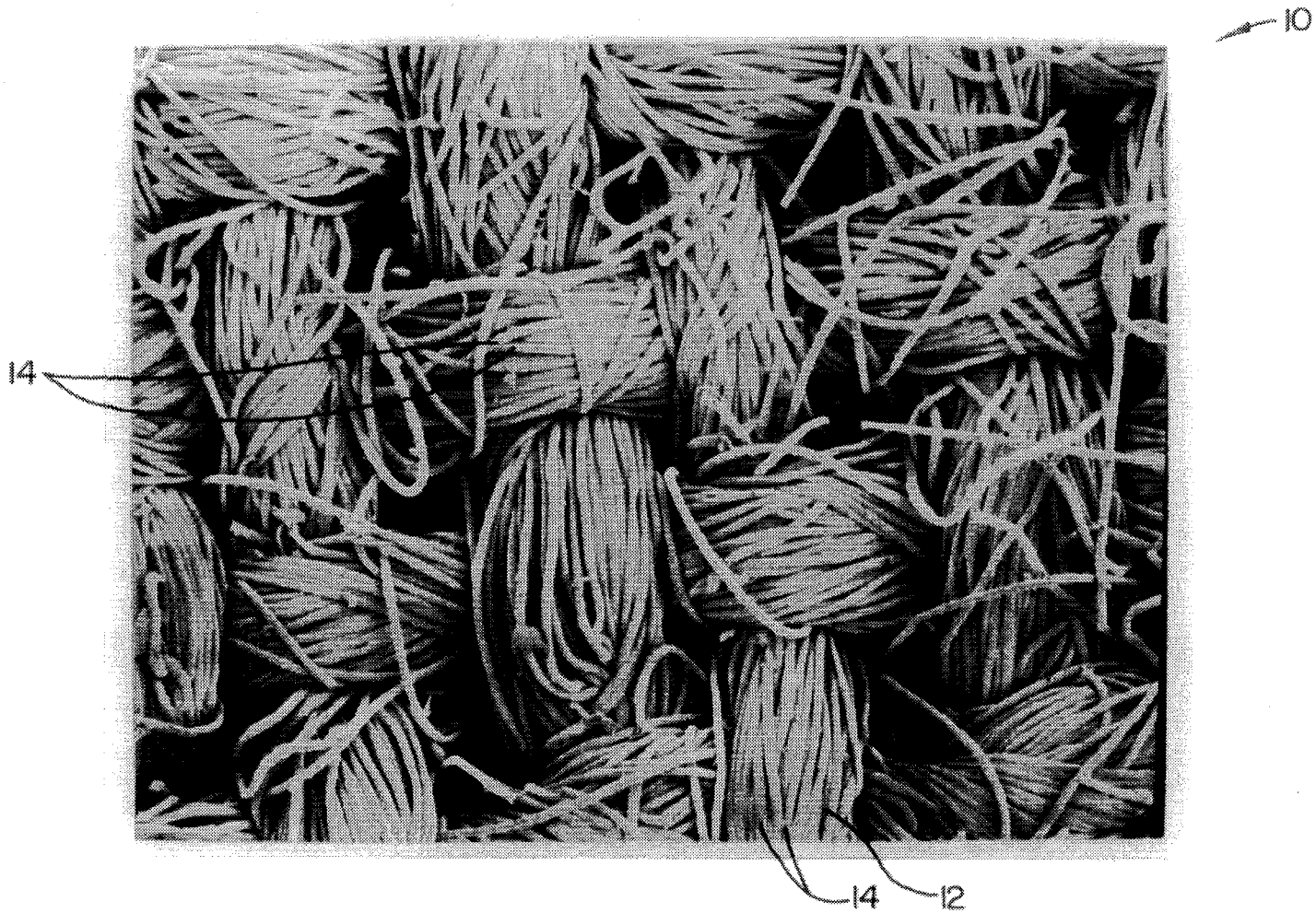
FIG. 2 is a photomicrograph of a basic institutional polyester sheeting fabric.
Figure 3:
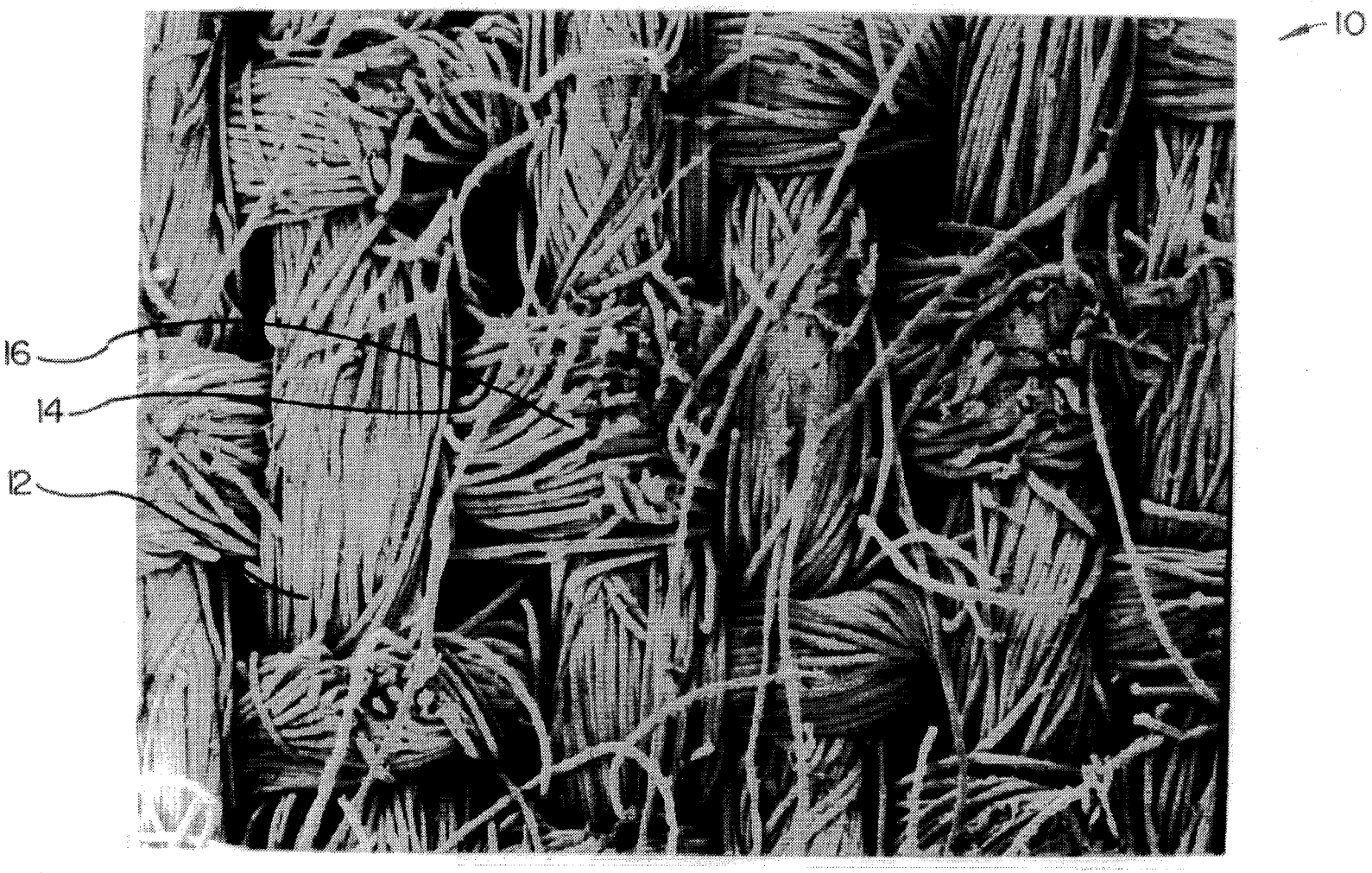
FIG. 3 is a photomicrograph of the institutional polyester sheeting fabric of FIG. 2 which has been microsanded.

FIGS. 2–5 are photomicrographs of institutional sheeting prepared according to the method of the invention, as the sheeting appears in various stages of production. FIG. 2 shows a section of fabric 10 as it appears subsequent to formation but prior to treatment by the anti-pill process. Yarns 12, which are formed from fibers 14, are woven to form the fabric FIG. 3 shows a photomicrograph of a piece of the same sheeting after it has been microsanded according to the anti-pill method to abrade some of the fibers 14 on the surface of the fabric 10. The abraded fibers 14 have abraded ends shown at 16, which give the fabric 10 a softer hand in addition to enhanced resistance to the formation of pills.

Figure 4:
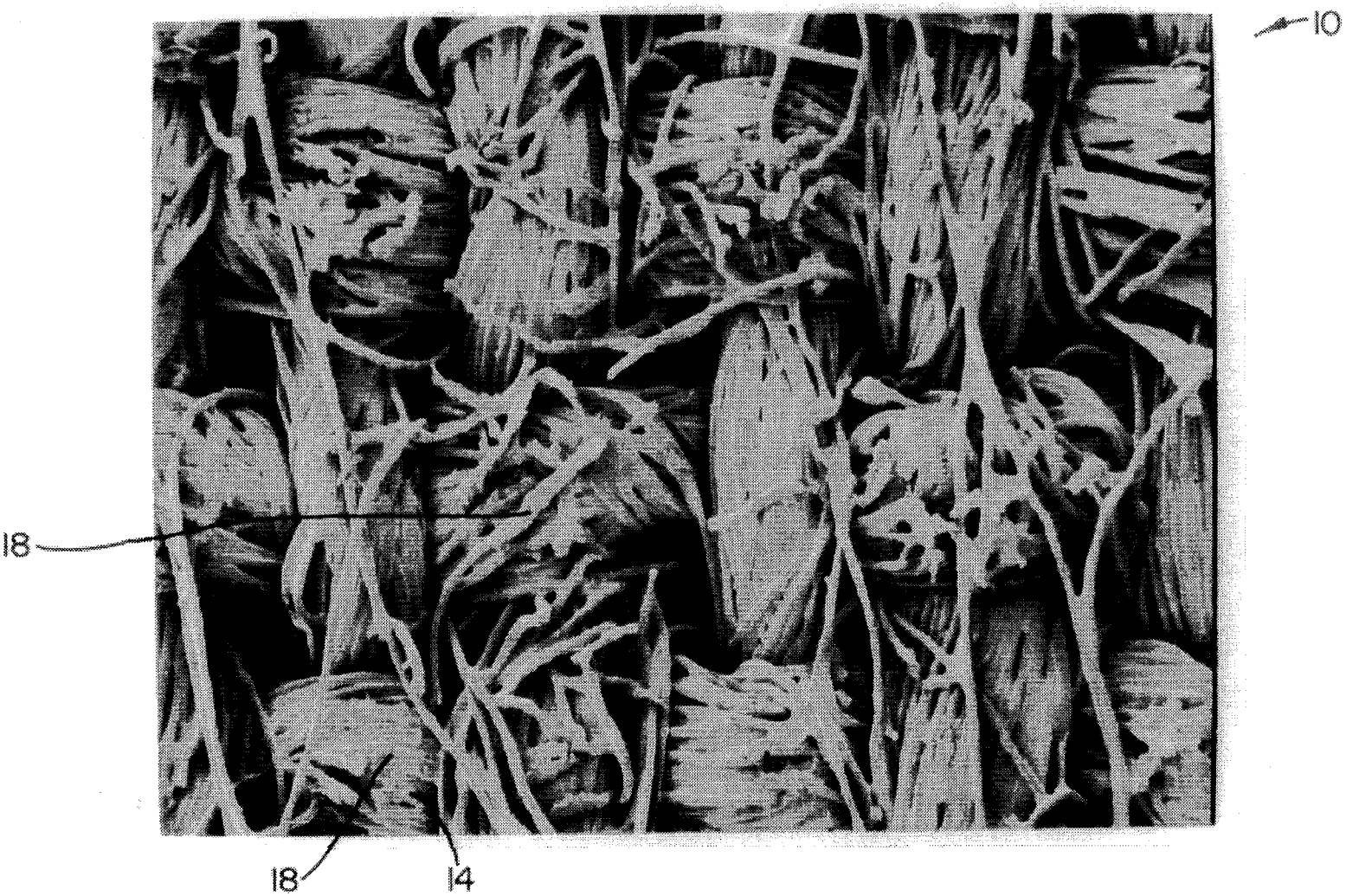
FIG. 4 is a photomicrograph of the microsanded institutional polyester sheeting fabric of FIG. 3 which has been treated with the anti-pill finish.

FIG. 4 is a photomicrograph of the fabric subsequent to application and crosslinking of the resin finish. The resin finish, shown generally at 18, can be seen as it coats the individual fibers 14 and bridges adjacent fibers.

Figure 5:
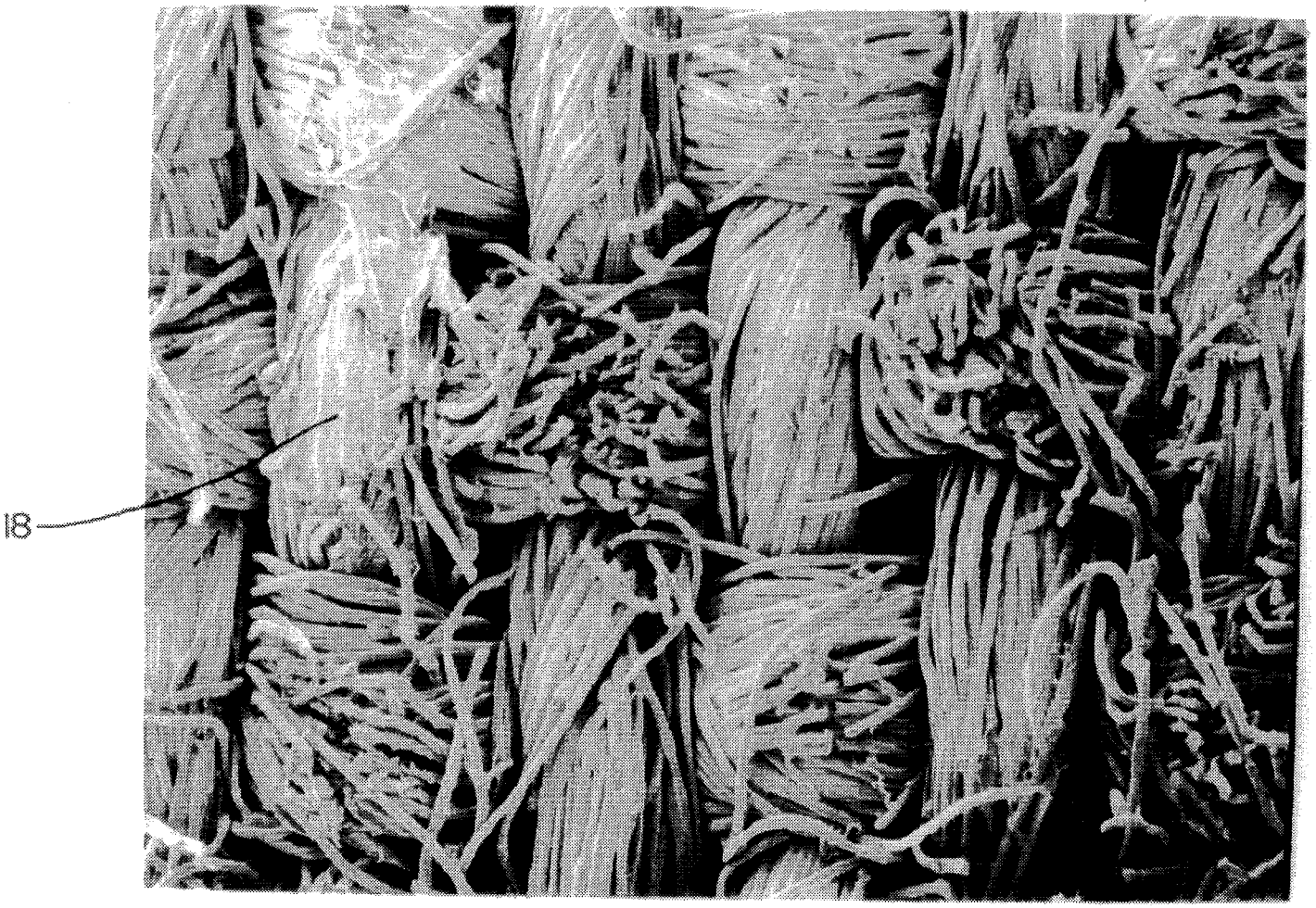
FIG. 5 is a photomicrograph of the microsanded, finish-treated institutional polyester sheeting fabric of FIG. 4 after the fabric has been subjected to 1000 washings at industrial pH and temperature levels.

The resin finish 18 adheres well to the fabric 10 and is maintained on the fabric following a high number of washings. As shown in the photomicrograph of FIG. 5, the resin finish 18 is still very apparent on the fabric 10 following 1000 washings at industrial pH and temperature levels. In addition, as shown in the photomicrograph, the fabric 10 does not display any evidence of pilling.

EXAMPLES

The following non-limiting examples are set forth to demonstrate the comparisons of pilling resistance of various fibers with and without the anti-pilling treatment of the invention.

A bath of resin finish was produced using the following concentrations of chemicals:

| Chemistry | % of Wt. of Bath | % Dry Add On |
|---|---|---|
| Self-crosslinking butyl acrylate/methyl acrylate/N-methylol acrylamide emulsion copolymer (55% solvents) | 12.5 | 3.49 |
| DMDHEU (57.5% solvents) | 5 | 1.31 |
| Polyethylene softener (50% solvents) | 1.5 | 0.47 |
| Magnesium Chloride hexahydrate/maleic acid catalyst (65.8% solvents) | 1.25 | 0.27 |
| Nonylphenolethyoxylate/ dioctylsodium sulfosuccinate surfactant (74.2% solvents) | 0.05 | 0.01 |

The fabrics listed below were microsanded on both sides using one roll of 320 grit sandpaper. They were then padded with the above resin finish, and dry cured on a tenter frame at 350° F. cloth temperature. The fabrics then underwent a compressive shrinkage treatment to improve the fabric hand.

The pure finished fabrics of the control group were treated with a softener and pressed. All fabrics were then tested for water absorbency using AATCC Test Method 79-1992 and subjected to random tumble, accelerated pill testing according to ASTM D 3512-82. In this test, the fabrics were abraded with sandpaper for the length of time set forth below. The fabrics were then rated as to the amount of pilling which resulted. A rating of 5.0 equals no pilling, with 1.0 being the highest amount of fabric pilling. The results of the tests are shown in the tables below:

TABLE I

| FABRIC TESTED: CONTROL GROUP | | | | |
|---|---|---|---|---|
| Fabric | Fiber Denier | Fiber Length | Fiber Cross-Section | Tenacity (G/D) |
| A | 0.9 | 1.5 | Round | 6.8 |
| B | 0.9 | 1.5 | Round | 6.8 |
| C | 1.2 | 1.5 | Round | 6.8 |
| D | 1.2 | 1.5 | Round | 6.8 |
| E | 1.2 | 1.5 | Round | 6.1 |
| F | 1.2 | 1.5 | Round | 6.1 |

TABLE II

| PURE FINISHED (i.e. FINISHED WITH SOFTENER ONLY) UNWASHED SHEETING FABRIC | | | | | | |
|---|---|---|---|---|---|---|
| | Width (in.) | Weight oz/yd | Count warp × fill | Pilling 30 min. | Pilling 60 min. | Absorbency |
| A | 64⅞ | 3.28 | 96 × 65 | 2.0 | 1.0 | instant |
| B | 64⅞ | 3.66 | 96 × 83 | 3.0 | 1.0 | instant |
| C | 65⅛ | 3.24 | 95 × 65 | 1–2 | 1.0 | 1.3 sec |
| D | 64¾ | 3.6 | 97 × 81 | 1–2 | 1.0 | 2 sec. |
| E | 65¼ | 3.22 | 96 × 65 | 2.0 | 1.0 | 4.5 sec |
| F | 65¼ | 3.58 | 96 × 82 | 2–3 | 1.0 | 2.3 sec |

TABLE III

| ANTI-PILLING RESIN FINISHED SHEETING FABRIC, UNWASHED | | | | | | |
|---|---|---|---|---|---|---|
| | Width (in.) | Weight oz/yd | Count warp × fill | Pilling 30 min. | Pilling 60 min. | Absorbency |
| A | 64¾ | 3.48 | 92 × 65 | 4–5 | 3.0 | 95.3 |
| B | 64½ | 3.8 | 97 × 82 | 4–5 | 3.0 | 113 sec |
| C | 64¾ | 3.42 | 96 × 65 | 4.0 | 2.0 | 82.3 sec |
| D | 64¾ | 3.77 | 96 × 81 | 4–5 | 2.0 | 66.3 sec. |
| E | 64¾ | 3.35 | 96 × 65 | 4.0 | 2.0 | 76.7 sec |
| F | 64¾ | 3.71 | 97 × 81 | 4–5 | 3.0 | 91 sec |

Several of the above institutional sheeting products were then washed 100 times at industrial pH and temperature levels with the following results:

TABLE IV

| PURE FINISHED (i.e. FINISHED WITH SOFTENER ONLY), AFTER 100 WASHES | | | | |
|---|---|---|---|---|
| | Weight oz/yd$^2$ | Count warp × fill | Pilling as is | Absorbency |
| A | 3.4 | 96 × 68 | 3.0 | 165 sec |
| C | 3.28 | 95 × 67 | 2–3 | 129.3 sec |
| D | 3.71 | 95 × 85 | 3.0 | 3 min+ |
| F | 3.71 | 96 × 85 | 2.0 | 3 min+ |

TABLE V

| ANTI-PILLING RESIN FINISHED | | | | |
|---|---|---|---|---|
| | Weight oz/yd$^2$ | Count warp × fill | Pilling as is | Absorbency |
| A | 3.42 | 96 × 67 | 4.0 | 3 min+ |
| B | 3.85 | 96 × 85 | 4.0 | 3 min+ |
| C | 3.36 | 95 × 67 | 4–5 | 3 min+ |
| D | 3.73 | 95 × 84 | 4.0 | 3 min+ |
| E | 3.32 | 95 × 67 | 4–5 | 3 min+ |
| F | 3.77 | 96 × 99 | 4.0 | 3 min+ |

As the data shows, the sheets which had undergone the anti-pilling treatment of the invention had substantially no significant pilling following 100 launderings while the pure finish samples of the control groups displayed a high amount of pilling.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A method of making a pill-resistant polyester fabric comprising:

microsanding a substantially all-polyester fabric to abrade the fabric surface, applying a finish comprising a self-crosslinking copolymer and a methylol derivative resin to the fabric, and treating the fabric bearing said finish under conditions sufficient to crosslink said finish to thereby form a pill resistant fabric.

2. The method in claim 1, wherein said self-crosslinkable copolymer comprises an acrylic copolymer.

3. The method in claim 2, wherein said acrylic copolymer comprises a polybutylacrylate copolymer.

4. The method in claim 1, wherein said methylol derivative resin comprises dimethyloldihydroxyethylene urea.

5. The method in claim 1, wherein said self-crosslinkable acrylic copolymer comprises a polybutylacrylate copolymer and said methylol derivative resin comprises dimethyloldihydroxyethylene urea.

6. The method in claim 1, wherein said substantially all-polyester fabric is a 97–100% polyester fabric.

7. The method in claim 1, wherein said substantially all-polyester fabric is a woven fabric.

8. The method in claim 1, wherein said substantially all-polyester fabric is a knit fabric.

9. A durable, pill-resistant polyester fabric comprising a microsanded fabric formed of substantially all polyester fibers and having a finish crosslinked thereon for imparting pill-resistance to the fabric, said finish comprising a self-crosslinking acrylic copolymer and a methylol derivative resin.

10. A fabric as in claim 9, wherein said self-crosslinking acrylic copolymer is a polybutylacrylate copolymer.

11. A fabric as in claim 9, wherein said methylol derivative resin is dimethyloldihydroxyethylene urea.

12. A fabric as in claim 9, wherein said self-crosslinking acrylic copolymer is a polybutylacrylate copolymer and said methylol derivative resin is dimethyloldihydroxyethylene urea.

13. A fabric as in claim 9, wherein said microsanded fabric is formed entirely from polyester fibers.

14. A fabric as in claim 9, wherein said microsanded fabric is a woven fabric.

15. A fabric as in claim 9, wherein said microsanded fabric is a knit fabric.

16. A method of making a pill-resistant polyester fabric comprising:

microsanding a woven fabric made from 100% polyester staple fibers to thereby abrade the fibers along the fabric surface, applying a finish comprising from about 10 to about 15% of a self-crosslinking acrylic copolymer and from about 3 to about 7% of a methylol derivative resin, and dry curing the fabric bearing the finish on a tenter frame to crosslink the finish about the polyester fibers to form a pill-resistant fabric.

17. A pill-resistant article of bedding comprising a substantially rectangular body, said body being formed from a fabric woven from spun yarns of 0.7–1.5 denier and approximately 5 grams/denier polyester fibers, said fabric having an abraded, finish-coated surface, wherein said finish comprises a self-crosslinking acrylic copolymer and an aminoplast resin.

* * * * *

UNITED STATES PATENT AND TRADEMARK OFFICE

CERTIFICATE OF CORRECTION

PATENT NO. : 5,591,516

DATED : January 7, 1997

INVENTOR(S) : Pamela J. Jaco, et al.

It is certified that error appears in the above-identified patent and that said Letters Patent is hereby corrected as shown below:

Column 4, line 10, delete "land" and insert --and-- therefor;

Column 5, line 38, delete "vinybenzamide" and insert --vinylbenzamide-- therefor;

Column 8, line 7, insert --10.-- after "fabric";

Column 8, line 14, insert --10-- after "fabric"; and

Column 9, line 38, delete "92 x 65" and insert --96 x 65-- therefor.

Signed and Sealed this

Fifteenth Day of April, 1997

Bruce Lehman

*Attest:*

BRUCE LEHMAN

*Attesting Officer*

*Commissioner of Patents and Trademarks*